US011459751B2

(12) United States Patent
Gosling

(10) Patent No.: US 11,459,751 B2
(45) Date of Patent: Oct. 4, 2022

(54) WALL SEAL

(71) Applicant: DIRTT Environmental Solutions, Ltd., Calgary (CA)

(72) Inventor: Geoff W. Gosling, Calgary (CA)

(73) Assignee: DIRTT ENVIRONMENTAL SOLUTIONS LTD

( * ) Notice: Subject to any disclaimer, the term of this patent is extended or adjusted under 35 U.S.C. 154(b) by 126 days.

(21) Appl. No.: 16/324,136

(22) PCT Filed: May 30, 2018

(86) PCT No.: PCT/US2018/035145

§ 371 (c)(1),
(2) Date: Feb. 8, 2019

(87) PCT Pub. No.: WO2019/013896

PCT Pub. Date: Jan. 17, 2019

(65) Prior Publication Data

US 2021/0285210 A1 Sep. 16, 2021

Related U.S. Application Data

(60) Provisional application No. 62/531,753, filed on Jul. 12, 2017.

(51) Int. Cl.
*E04B 1/68* (2006.01)
*E04F 19/02* (2006.01)
(Continued)

(52) U.S. Cl.
CPC ..... *E04B 2/828* (2013.01); *E04B 1/6815* (2013.01); *E04B 2/7405* (2013.01); *E04F 19/022* (2013.01)

(58) Field of Classification Search
CPC ..... E04B 2/828; E04B 2/7405; E04B 2/7409; E04B 2/7412; E04B 2/7414;
(Continued)

(56) References Cited

U.S. PATENT DOCUMENTS 3,082,848 A * 3/1963 Keller ..... E04C 2/54 52/417
3,367,076 A * 2/1968 O'Brien ..... E04C 2/296 52/394
(Continued)

FOREIGN PATENT DOCUMENTS

CN 110331810 A * 10/2019 ..... E04B 9/04
GB 1419067 A 12/1975

OTHER PUBLICATIONS

International Search Report and Written Opinion from International Patent Application No. PCT/US2018/035145 filed May 30, 2018.
(Continued)

*Primary Examiner* — Kyle J. Walraed-Sullivan
(74) *Attorney, Agent, or Firm* — Workman Nydegger

(57) ABSTRACT

A system for sealing a space defined between a modular wall and a permanent structure includes a sealing material connected to the permanent structure and the modular wall and spanning the space defined therebetween. The sealing material is configured to transform from an expanded state to a recovered state in response to a stimulus to form a seal. The stimulus can be, for example, heat, whereby heating the sealing material at or above the transition temperature for the sealing material causes the sealing material to transition from the expanded state to the recovered state.

17 Claims, 4 Drawing Sheets

(51) Int. Cl.
*E04B 2/82* (2006.01)
*E04B 2/74* (2006.01)

(58) Field of Classification Search
CPC ..... E04B 2/7429; E04B 2/82; E04B 2/821; E04B 2/822; E04B 2/824; E04B 2/825; E04B 1/6815; E04B 1/68; E04B 1/6803; E04B 1/6806; E04B 1/6807; E04B 1/6812; E04B 1/6813; E04B 2002/7418; E04B 9/244; E04F 21/0038
See application file for complete search history.

(56) References Cited

U.S. PATENT DOCUMENTS 3,707,060 A * 12/1972 Jansen, Jr. ..... E04B 2/825 52/241
3,732,659 A * 5/1973 LaBarge ..... E04B 1/6803 52/461
3,742,669 A * 7/1973 Mansfeld ..... E04B 1/681 52/396.07
3,744,826 A * 7/1973 Hawes ..... E04B 1/6803 52/586.2
3,789,567 A * 2/1974 Rae ..... E04B 2/7881 52/584.1
3,803,787 A * 4/1974 Daggy ..... E04B 2/7409 52/241
3,830,027 A * 8/1974 Paisley ..... E04B 2/825 52/211
3,842,560 A * 10/1974 Campbell ..... E04C 2/34 52/468
4,030,852 A * 6/1977 Hein ..... E04B 1/6803 404/66
4,148,167 A * 4/1979 Puccio ..... E04B 1/681 404/65
4,186,539 A * 2/1980 Harmon ..... E04B 1/6129 52/580
4,344,475 A * 8/1982 Frey ..... A47G 5/00 16/225
4,522,413 A * 6/1985 Nicholas ..... E01C 11/106 277/645
4,635,422 A * 1/1987 Nowack ..... F16B 5/0064 52/406.1
4,719,732 A * 1/1988 Bernard ..... E04F 13/06 156/85
4,781,003 A * 11/1988 Rizza ..... E04B 1/6804 404/69
4,852,317 A * 8/1989 Schiavello ..... E04B 2/7424 52/239
4,858,947 A * 8/1989 Yee ..... B62B 7/08 280/643
4,910,938 A * 3/1990 McGee ..... E04B 1/34321 52/481.2
4,999,960 A * 3/1991 Herwegh ..... E04B 2/88 52/235
5,042,765 A * 8/1991 Widerstrom ..... A47B 91/04 248/188.3
5,085,293 A * 2/1992 Aime ..... B66B 13/308 187/400
5,086,599 A * 2/1992 Meyerson ..... E04B 1/617 52/309.9
5,209,498 A * 5/1993 Colin ..... B61D 19/02 277/646
5,233,803 A * 8/1993 Bockmiller ..... E04B 2/7401 52/239
5,272,850 A * 12/1993 Mysliwiec ..... E04B 1/6158 52/582.2
5,448,865 A * 9/1995 Palmersten ..... E04B 1/6129 52/309.9
5,450,694 A * 9/1995 Goranson ..... E04B 2/7405 16/225
6,267,169 B1 * 7/2001 McDonald ..... E05D 15/262 160/193
6,427,405 B1 * 8/2002 Moriya ..... E04F 13/0889 52/396.04
6,438,914 B1 * 8/2002 Robertson ..... E04F 13/06 52/287.1
7,194,846 B2 * 3/2007 Swiszcz ..... E04B 9/001 428/116
7,458,190 B2 * 12/2008 Isaac ..... E04B 2/7401 52/396.03
8,196,365 B2 * 6/2012 Parshad ..... E04B 2/7448 52/239
9,068,358 B2 * 6/2015 MacDonald ..... E04F 13/083
9,572,286 B2 * 2/2017 Greeson ..... B60J 10/24
9,617,731 B2 * 4/2017 Baxter ..... E04B 2/7405
9,955,616 B2 * 4/2018 Krietzman ..... H05K 13/04
10,385,973 B2 * 8/2019 McGrath ..... F16J 15/027
10,494,811 B1 * 12/2019 Gussenbauer ..... E04B 2/828
2001/0000373 A1 * 4/2001 Beck ..... B65B 7/2885 53/478
2003/0131546 A1 * 7/2003 Kunz ..... E04F 13/068 52/255
2004/0045234 A1 * 3/2004 Morgan ..... E04B 2/7411 52/232
2004/0255537 A1 * 12/2004 Dalgleish ..... E04F 13/068 52/506.01
2005/0066600 A1 * 3/2005 Moulton ..... E01D 19/06 52/393
2005/0229524 A1 * 10/2005 Bennett ..... B32B 21/06 52/481.1
2006/0000177 A1 * 1/2006 Salzano ..... F16B 5/0692 52/474
2007/0251183 A1 * 11/2007 Thiagarajan ..... E04D 3/32 52/590.1
2011/0135387 A1 * 6/2011 Derrigan ..... E01D 19/06 404/69
2011/0138719 A1 * 6/2011 Gosling ..... E04B 2/828 52/284
2013/0161273 A1 * 6/2013 Borowsky ..... H05K 7/20736 211/26
2015/0275506 A1 * 10/2015 Klein ..... E04B 1/68 277/628
2015/0354210 A1 * 12/2015 Stahl, Jr ..... E04B 2/7409 277/644
2016/0017599 A1 * 1/2016 Klein ..... E04B 1/948 52/232
2016/0097197 A1 * 4/2016 Pilz ..... E04B 2/7411 52/232
2016/0208480 A1 * 7/2016 Hensley ..... B29C 44/5627
2016/0237689 A1 * 8/2016 Hensley ..... E04D 13/1415
2017/0268222 A1 * 9/2017 Witherspoon ..... E04B 1/944
2018/0251984 A1 * 9/2018 Bodner ..... E04F 19/022
2019/0077596 A1 * 3/2019 Stefani ..... F16F 15/04
2019/0078323 A1 * 3/2019 Strickland ..... E04B 1/6812
2019/0169836 A1 * 6/2019 Fisher ..... E04B 5/36
2019/0316348 A1 * 10/2019 Pilz ..... E04B 2/58
2019/0316350 A1 * 10/2019 Pilz ..... E04B 2/7411
2019/0382621 A1 * 12/2019 Rosenthal ..... C09J 7/35
2020/0123766 A1 * 4/2020 De Graaf ..... E04B 2/7409
2020/0263418 A1 * 8/2020 Klein ..... E04B 1/947
2021/0010257 A1 * 1/2021 Klein ..... E04B 1/82
2021/0156190 A1 * 5/2021 Deiss ..... E04B 1/6812
2021/0222422 A1 * 7/2021 Griffith ..... E04F 19/062

OTHER PUBLICATIONS

Communication pursuant to Article 94(3) EPC received for European Patent Application No. 18733743.1, dated Oct. 15, 2021, 8 pages.

* cited by examiner

WALL SEAL

CROSS-REFERENCE TO RELATED APPLICATIONS

The present invention is a 35 U.S.C. § 371 U.S. National Stage of PCT Application No. PCT/US2018/035145, filed on May 30, 2018, which claims priority to U.S. Provisional Patent Application No. 62/531,753, filed Jul. 12, 2017. The entire content of each of the aforementioned patent applications is incorporated herein by reference.

BACKGROUND

Technical Field

This disclosure generally relates to systems, methods, and apparatuses for sealing a wall, floor, and/or ceiling.

Related Technology

A builder or installer may use modular walls to divide an open space within a building into individual spaces. Generally, modular walls can include a series of wall modules that connect to each other. The individual wall modules can be freestanding or rigidly attached to one or more support structures. In particular, a manufacturer or assembler can align and join various wall modules together to divide an open space and by doing so form individual spaces, such as an office, a room, a hallway, etc.

At least one advantage of modular walls is that they are often relatively easy to configure. In addition, modular wall systems can be less expensive to set up and can allow for reconfiguration more easily than permanent office dividers. For example, using modular wall systems, an installer may quickly form offices, conference areas, etc., in an undivided space of the building. If the user or occupants of the building desire to change the office space, they can readily reconfigure the space and may partially reuse existing wall modules or modular walls.

Unfortunately, many buildings are not constructed with perfectly level floors, ceilings and even walls. That is, in many buildings, one or more walls may pitch inward/outward such that the wall is not perfectly orthogonal to the floor and/or ceiling. This can be problematic when a substantially straight modular wall is attached to an existing wall. If the wall is not straight or the ceiling and/or floor bows near the wall, gaps will remain between the modular wall and one or more of the existing wall, ceiling, and/or floor. Accordingly, there are a number of disadvantages in wall modules and modular walls that can be addressed.

BRIEF SUMMARY

Implementations of the present disclosure solve one or more of the foregoing or other problems in the art with sealing spaces between modular walls and permanent structures. In particular, one or more implementations can include a system for sealing a wall. The system can include a permanent structure, a modular wall, and a sealing material connected to the permanent structure and the modular wall and spanning a distance therebetween. The sealing material can be configured to transform from an expanded state to a recovered state, forming a seal between the permanent structure and the modular wall when the seal is in the recovered state.

In some implementations, the sealing material transforms from the expanded state to the recovered state when heated at or above a given temperature. The temperature can be at least about 75° C., at least about 100° C., at least about 125° C., at least about 150° C., or higher. In one or more implementations, the sealing material is made from one or more of polyolefin, polyurethane, neoprene, polyvinylchloride, polypropylene, or similar.

The present disclosure can also include devices for sealing a space between a modular wall and a permanent structure. For example, a device can include a first attachment member configured to attach to the permanent structure, a second attachment member configured to attach to the modular wall, and a sealing material coupled to the first and second attachment members. The sealing material can be configured to contract from an expanded state to a recovered state, thereby sealing the space between the modular wall and the permanent structure.

The present disclosure can also include methods for sealing a space between a permanent structure and a modular wall. For example, a method can include coupling a first arm of a sealing device to the permanent structure, coupling a second arm of the sealing device to the modular wall such that a sealing material of the sealing device spans the space between the permanent structure and the modular wall, and transitioning the sealing material from an expanded state to a recovered state causing a sealing of the space between the permanent structure and the modular wall. In some implementations, transitioning the sealing material comprises heating the sealing material, for example, between about 75° C.-150° C. or higher.

Accordingly, systems, methods, and devices for sealing a space between a permanent structure and a modular wall are disclosed.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which:

FIG. 3A illustrates a beginning or first time point, FIG. 3B illustrates a second time point chronologically after the first time point, FIG. 3C illustrates a third time point chronologically after the second time point, and FIG. 3D illustrates a fourth or final chronological time point.

DETAILED DESCRIPTION

Figure 1:
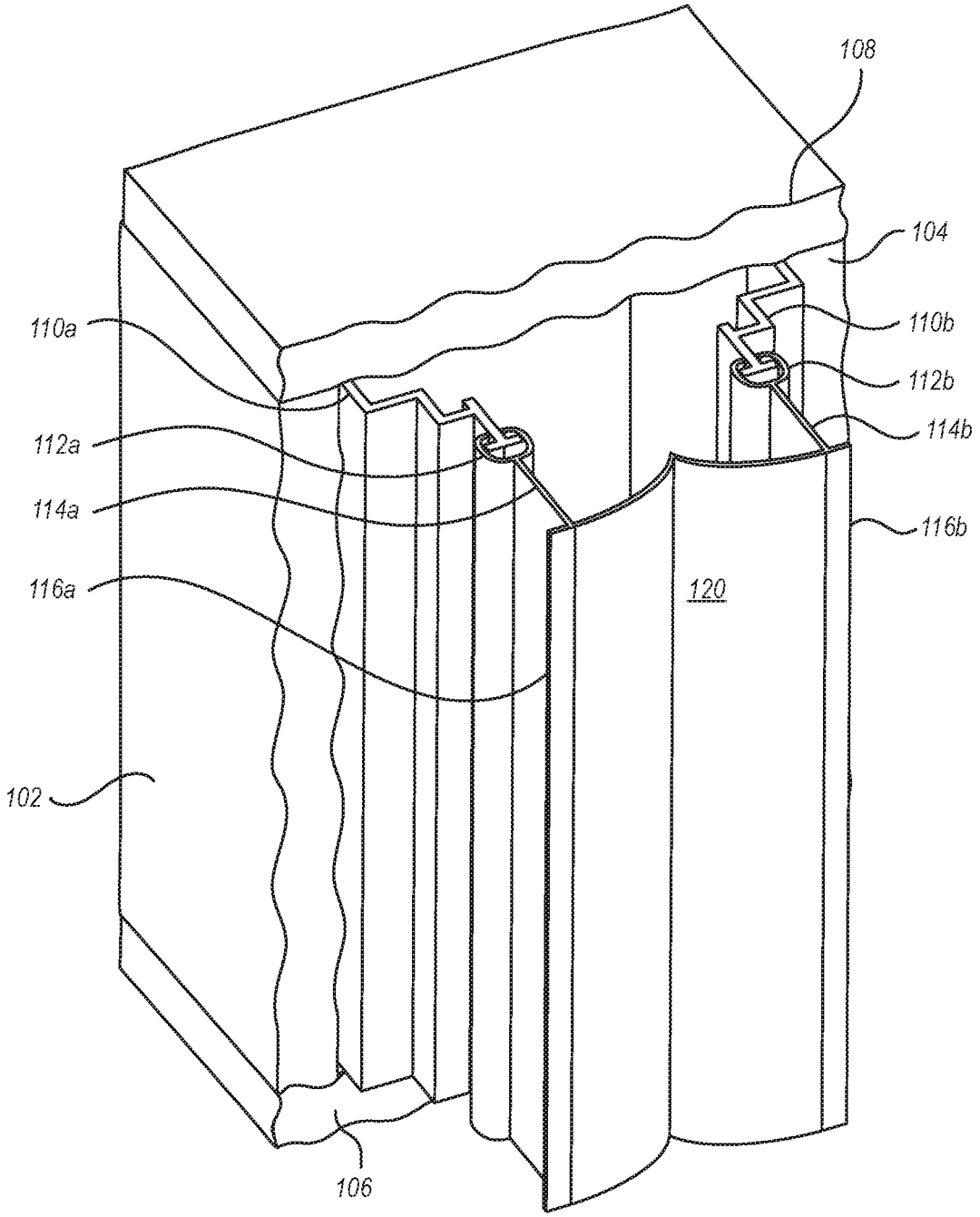
FIG. 1 illustrates a perspective view of a system for sealing a wall in accordance with one implementation of the present disclosure.

The present disclosure extends to implementations that solve one or more problems in the art of sealing spaces between modular walls and permanent structures. In particular, one or more implementations can include a system for sealing a wall. The system can include a permanent structure, a modular wall, and a sealing material connected to the permanent structure and the modular wall and spanning a distance therebetween. The sealing material can be configured to transform from an expanded state to a recovered state, forming a seal between the permanent structure and the modular wall when the seal is in the recovered state.

In general, and as described more fully herein, the present disclosure includes systems, methods, and devices for sealing a space. In some embodiments, the space is disposed between, or otherwise defined by, a modular wall and a permanent structure. As used herein, the term "permanent structure" includes pre-existing walls, floors, and ceilings. In some implementations, the floor or ceiling is a false floor or a false ceiling (e.g., a drop ceiling or a raised floor). In other implementations, the floor or the ceiling do not include false floors or false ceilings, but rather, the floor and/or the ceiling is a structural boundary of a given room within a larger building.

It should be appreciated that in many buildings the permanent structures are not true with respect to one another. For example, a preexisting wall can be tilted along a horizontal axis such that a top and/or a bottom of the wall is not orthogonal to the ceiling and/or the floor, respectively. Additionally, or alternatively, a preexisting wall can be skewed along a vertical axis such that at least a portion of the preexisting wall is not parallel with an opposing wall. In some implementations, the tilting and/or skewing of a preexisting wall is purposeful. However, in some implementations, the tilting and/or skewing of a preexisting wall is unintentional. Regardless of the reason, permanent structures that are not true with respect to each other can cause problems when installing modular walls, as many modular walls (or the frames associated therewith) are manufactured with straight, flat edges and orthogonal corners.

For example, if a floor undulates, slants, or is otherwise not a flat, level surface, a lower end of a modular wall can leave a gap between uneven surfaces. Additionally, or alternatively, it may also cause a narrowing or widening of the space between the top portion of the modular wall and the ceiling (e.g., the space widens if the floor has a negative slope or narrows if the floor has a positive slope). This problem can negatively impact connection of the modular wall with a preexisting wall, as the connecting edge of the modular wall will not be flush against the pre-existing wall. This problem can be additionally compounded if the preexisting wall is not orthogonal to the modular wall.

Systems, methods, and devices disclosed herein are directed to sealing spaces that may be left between the modular wall and permanent structures for the same or different reasons as those described above. Generally, a sealing material can be associated with the modular wall and a permanent structure such that the sealing material spans the space therebetween. In some implementations, the sealing material is relaxed or otherwise not taut when associated with the modular wall and a permanent structure. In other implementations, the sealing material is stretched between the modular wall and the permanent structure. After being associated with the modular wall and the permanent structure, the sealing material can undergo a mechanical change, or in some embodiments a chemical change, to seal the space. For example, the sealing material may transition from an expanded state to a recovered, or memory, state, and in doing so, the sealing material shrinks, thereby providing a tight seal between the modular wall and the permanent structure.

In some implementations, the sealing material can be a heat shrink material such as, for example, polyolefin, polyurethane, neoprene, polyvinylchloride, polypropylene, a similar material, or combinations thereof. The heat shrink material can be attached or otherwise associated with the modular wall and a permanent structure in a stretched or expanded state, and when heat is applied to the heat shrink material (e.g., using a heat gun), the heat shrink material transitions to a recovered state. Transitioning between an expanded state and a recovered state can form a seal between the modular wall and the permanent structure. In some implementations, the seal is airtight and/or water tight. In some implementations, seals are created between the modular wall and a plurality of permanent structures to create an airtight and/or watertight seal between the spaces divided by the modular wall. For example, seals can be created between the modular wall and a preexisting wall, the modular wall and the ceiling, and/or the modular wall and the floor.

In some implementations, the heat shrink material has a heat shrink ratio (e.g., the length of the material in the recovered state versus the length of the material in the expanded state) of 1:2. In some implementations, the heat shrink material has a heat shrink ratio of 1:1.1, 1:1.25, 1:1.5, 1:1.75, 1:2.5, 1:3, 1:4, 1:5, 1:6, 1:7, 1:8, 1:9, or 1:10. The heat shrink ratio can be a selected or designed based upon the type of material used within the heat shrink material, the process by which the material is manufactured, and/or the process by which the expanded or recovered states are formed.

Additionally, the heat shrink material can be configured to transition between an expanded state and a recovered state when the heat shrink material exceeds a given transition temperature. In some implementations, it is advantageous for the transition temperature to be greater than the temperature observed during storage or transport, thereby preventing the heat shrink material from inadvertently transitioning to the recovered state before being utilized for its intended purpose, as disclosed herein. Accordingly, the transition temperature can be at least about 75° C., at least about 100° C., at least about 125° C., at least about 150° C., or higher and can be an inherent property of the materials that make up the heat shrink material or a result of the process by which the expanded or recovered states are formed.

As used herein, the term "about" represents an amount or condition close to the stated amount or condition that still performs a desired function or achieves a desired result. For example, the term "about" may refer to an amount or condition that deviates by less than 10%, or by less than 5%, or by less than 1%, or by less than 0.1%, or by less than 0.01% from a stated amount or condition.

The transition temperature can additionally be selected from those temperatures that are within or that exceed the temperatures output by common commercial heating products (e.g., hair dryers or similar). For example, the transition temperature can be greater than about 100° C., greater than about 125° C., or greater than about 150° C. Accordingly, in some implementations, a heat gun or other similar device is used to transition the heat shrink material from the expanded state to the recovered state by heating the heat shrink material above the transition temperature. The amount of heat produced by the heat gun which is subsequently imparted to the heat shrink material can cause the transition to occur more rapidly or more slowly. For example, a more intense heat produced by a heat gun that is directed at the heat shrink material can cause a more rapid transition of the affected heat shrink material than a diffuse, less intensive heat.

In some implementations, the heat shrink material has a range of heat trained ratios along one or more axes thereof. For example, a heat shrink material may have a heat shrink ratio of 1:4 in a first portion or axis and a heat shrink ratio of 1:2 in a second portion or axis. In an exemplary implementation, the first axis is a longitudinal axis and the second axis is a transverse axis perpendicular to the longitudinal axis. In such an implementation, the heat shrink material is configured to shrink in two directions. This may be useful, for example, in sealing a modular wall to an adjacent wall and to the ceiling and/or to the floor.

For example, a sealing material can include a heat shrink material, and a first side of the sealing material can be secured to the modular wall, a second, opposing side of the sealing material (along the transverse axis of the heat shrink material) can be secured to an adjacent preexisting wall, and an adjacent side of the sealing material (along the longitudinal axis of the heat shrink material) can be secured to the ceiling or floor. Once secured, heat can be applied to the heat shrink material to cause a transition of the heat shrink material to the recovered state. This can cause a tightening of the junction spanned by the heat shrink material. In some implementations, the heat shrink material is longer than the space between the modular wall and the permanent structure when the heat shrink material is in an expanded state and shorter (or the same distance) than the same space when the heat shrink material is in a recovered state. As the heat shrink material transitions to the recovered state, it can bias the modular wall or other components of the sealing material toward the permanent structure. Differing and/or combining two or more materials having different heat shrink ratios within the same sealing material can affect, for example, the tautness of a seal formed thereby or the range of heat trained ratios along one or more axes.

In some implementations, the sealing material is translucent. In some implementations, the sealing material is opaque. The sealing material can additionally, or alternatively, include a color, plurality of colors, a pattern, and/or a visual indication that the sealing material has transitioned from an expanded state to a recovered state.

Referring now to the Figures, FIG. 1 illustrates a system for sealing a wall in accordance with one implementation of the present disclosure. FIG. 1 includes a modular wall 102, an opposing preexisting wall 104, a floor 106, and a ceiling 108. For the ease of illustration, the modular wall 102, opposing preexisting wall 104, floor 106, and ceiling 108 are depicted as partial cross-sections (illustrated by wavy lines) to better illustrate components of the disclosed sealing system.

As shown in FIG. 1, the modular wall 102 is associated with a wall bracket 110*a*, and similarly, the preexisting wall 104 is associated with wall bracket 110*b*. A device for sealing the space between the modular wall 102 and the preexisting wall 104 is associated with the modular wall 102 and the preexisting wall 104 through attachment/coupling of a first attachment member 112*a* to the wall bracket 110*a* of the modular wall 102 and attachment/coupling of a second attachment member 112*b* to the wall bracket 110*b* of the preexisting wall 104. The attachment members 112*a*, 112*b* can be associated with the wall brackets 110*a*, 110*b* by an interference fit (as illustrated in FIG. 1) or by other means known in the art, including, for example, chemical coupling (e.g., an adhesive, glue, cement, etc.), a mechanical coupling (e.g., compression coupling, by tenon and mortise, riveting, bolting, screwing, etc.), or similar.

In some implementations, the attachment members 112*a*, 112*b* are partially flexible and can be flexed around the bracket and retained there by frictional forces. Additionally, or alternatively, the attachment members 112*a*, 112*b* can slide over a portion of the wall bracket 110*a*, 110*b*, thereby securing the device to the modular wall and permanent structure.

As illustrated in FIG. 1, the attachment members 112*a*, 112*b* are coupled to sidewalls 114*a*, 114*b* and extension elements 116*a*, 116*b*. In some implementations, the attachment members, sidewalls, and extension elements are portions of the same unified or singular element. In other implementations, they are fused or otherwise independently coupled together. One or more of the attachment members, sidewalls, and/or extension elements can be made of any suitable material. As shown in FIG. 1, the attachment members 112*a*, 112*b*, sidewalls 114*a*, 114*b*, and extension elements 116*a*, 116*b* can be made of a non-heat-shrinking material, including, for example, a thermoplastic (e.g., poly (methyl methacrylate), acrylonitrile butadiene styrene, polyactic acid, polypropylene, polyethylene, polyvinyl chloride, polycarbonate, etc.), an elastomer (e.g., polyisoprene, polybutadiene, nitrile rubbers, polychloroprene, etc.), a thermoplastic elastomer (e.g., thermoplastic olefins, thermoplastic polyurethanes, etc.), silicone, combinations thereof, or similar. In some embodiments, the extension elements and/or the sidewalls can comprise a heat shrinkable material.

Figure 2:
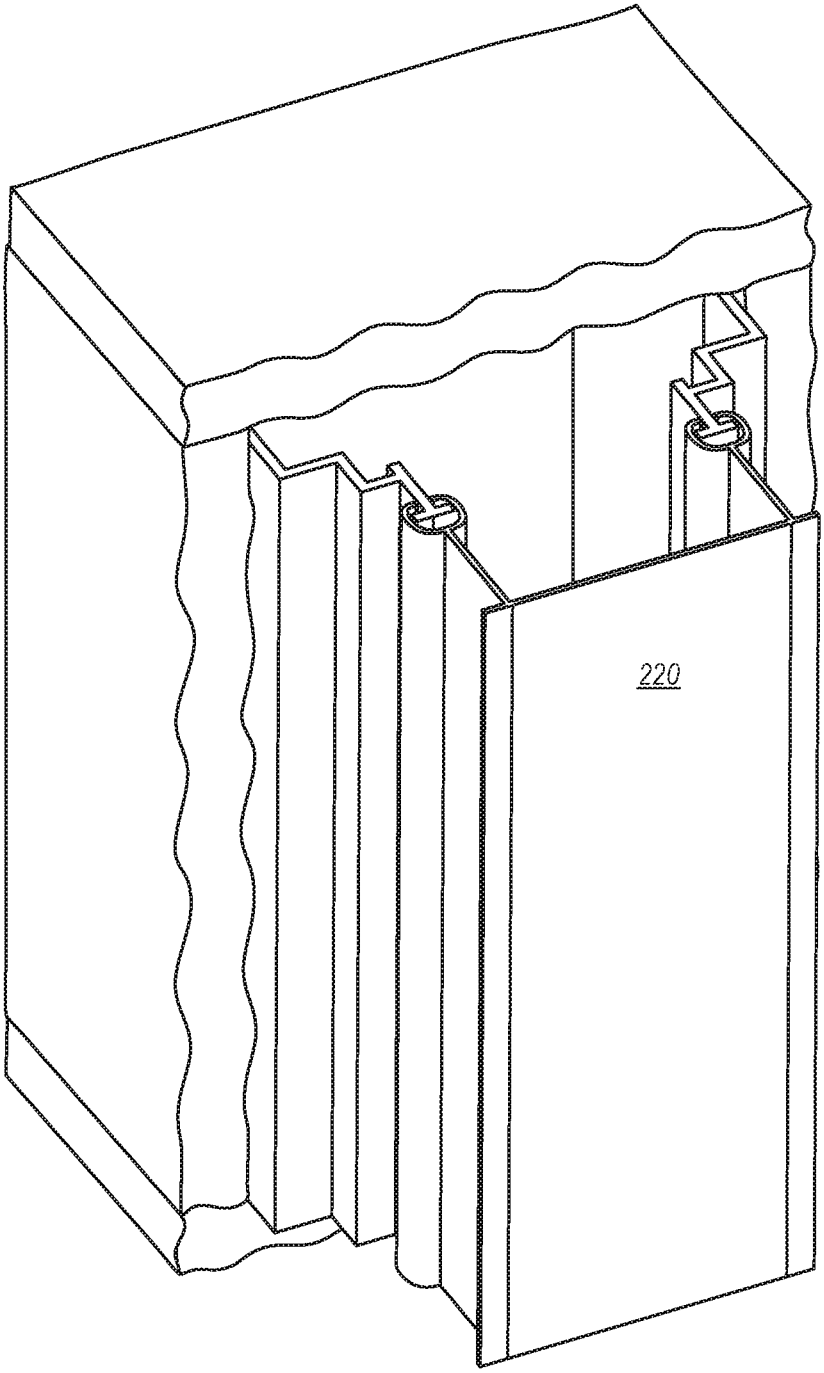
FIG. 2 illustrates the system in FIG. 1 after being heat treated in accordance with one implementation of the present disclosure.

The sealing device of FIG. 1 additionally includes a sealing material 120 coupled to the extension elements 116*a*, 116*b* and the sidewalls 114*a*, 114*b*. As shown, the sealing material 120 is in an expanded state. The expanded sealing material 120 can be made from any material that transitions between an expanded state to a recovered in response to a stimulus. For example, the expanded sealing material 120 of FIG. 1 is illustrated as a heat shrinkable polymer. Upon exposure to heat above at least about 75° C., the heat shrinkable polymer retracts to form a seal (shown, for example, as seal 220 in FIG. 2). As used herein, the term "seal" can connote a physical interaction or proximity between the sealing device and the associated modular wall and/or permanent structure, which can be non-airtight or non-fluid tight, or it can cause an airtight or fluid tight seal to form therebetween. The "seal" may additionally, or alternatively, connote the occlusion of a space or gap between the modular wall and a permanent structure by at least a portion of the sealing device.

The sealing material can include one or more materials selected from: polyolefin, polyurethane, neoprene, polyvinylchloride, or polypropylene. The degree by which the material shrinks (also known as the shrink ratio) can also vary from implementation to implementation. In some implementations, the shrink ratio (e.g., the length of the material in the recovered state versus the length of the material in the expanded state) is 1:2. In some implementations, the heat shrink ratio is 1:1.1, 1:1.25, 1:1.5, 1:1.75, 1:2.5, 1:3, 1:4, 1:5, 1:6, 1:7, 1:8, 1:9, or 1:10.

In some implementations, the sealing material shrinks to a greater degree than in others. For example, the modular wall and the preexisting wall may not be parallel with each other. Instead, the preexisting wall could, for example, be tilted such that the top of the preexisting wall leans toward the modular wall. Such a configuration could be evidenced by the expanded sealing material of the sealing device being tighter between the modular wall and the preexisting wall at a first location (e.g., near the bottom of the walls) and looser between the modular wall and the preexisting wall at a second location (e.g., near the top of the walls), assuming the length of expanded sealing material spanning the first location is the same or substantially the same as the length of expanded sealing material spanning a second location. Stated another way, the angle roughly formed at the apex of a fold line running down the expanded sealing material may be an obtuse angle at or near the first location of the expanded sealing material but gradually becomes less obtuse until the angle is by its appearance an acute angle at or near the second location of the expanded sealing material.

In the foregoing implementation, the sealing material can be transitioned from an expanded state toward the recovered state (e.g., by heating). In doing so, the sealing material at the second location may fully transition to a recovered state, whereas the sealing material at the first location may not fully transition to the recovered state. That is, the distance between the modular wall and the permanent structure at the second location is less than or equal to the length of the sealing material in the recovered state, whereas the distance between the modular wall and the permanent structure at the first location is less than the length of the sealing material in the expanded state but greater than the length of the sealing material in the recovered state.

In the former instance, the tension between each side of the sealing material, which is applied by the rigid sidewalls (e.g., sidewalls 114*a*, 114*b* of FIG. 1), is less than the compression forces of the transitioning sealing material. In the latter instance, the sidewalls of the sealing device may be rigid and effectively resist deformation (elastic or plastic) in response to the compression forces of the transitioning sealing material. Stated another way, the tension forces applied by the sidewalls is greater than the compressive forces of the transitioning sealing material, which prevents the sealing material from fully transitioning to the recovered state.

In some implementations, the attachment members are associated directly with the sealing material. In some implementations, the extension elements extend from the sidewall or a first end of the sealing material to an inner surface of the wall module and/or from the opposing sidewall or second end of the sealing material to an inner surface of the preexisting wall. The extension elements may serve as a barrier and/or act to occlude visibility of the edges of and/or the interior space between the modular wall and the permanent structure.

Figure 3A:
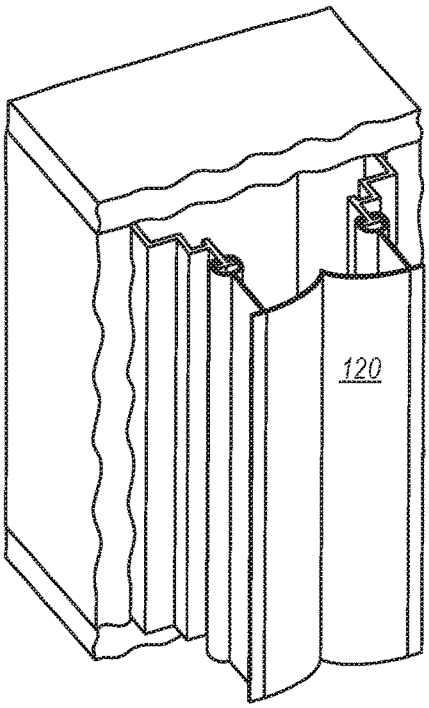
FIGS. 3A-3D are illustrations of a time lapse of a wall being sealed in accordance with one implementation of the present disclosure.
Figure 3B:
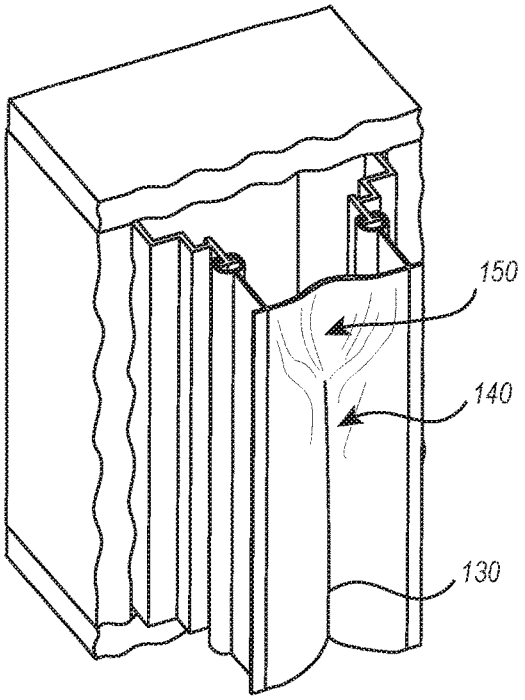
Figure 3C:
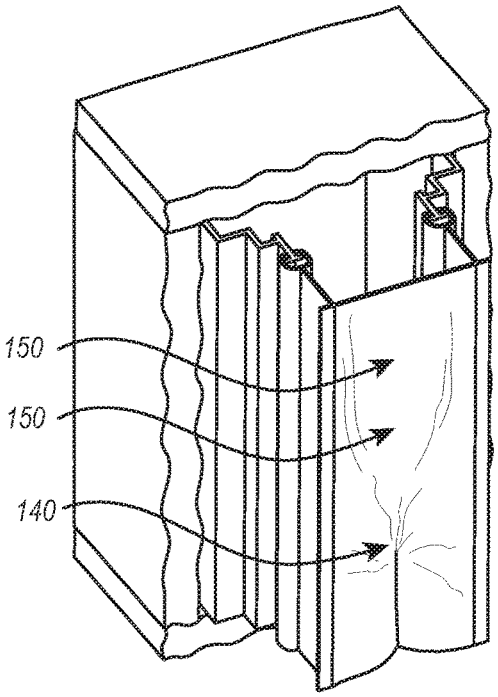
Figure 3D:
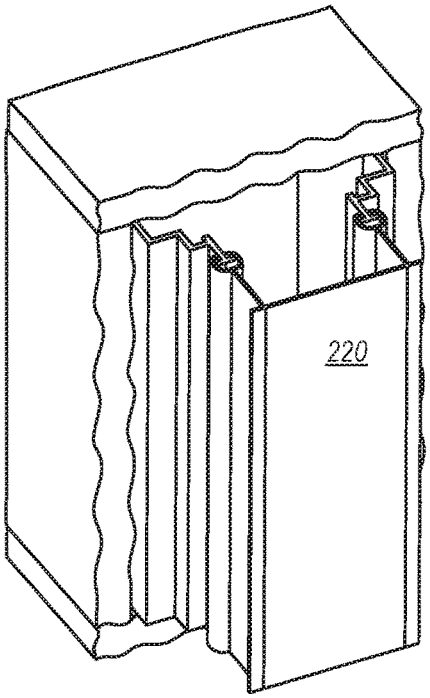

Referring now to FIGS. 3A-3D, illustrated are images of a time lapse of a wall being sealed in accordance with one implementation of the present disclosure. FIG. 3A illustrates a beginning or first time point. FIG. 3B illustrates a second time point chronologically after the first time point. FIG. 3C illustrates a third time point chronologically after the second time point, and FIG. 3D illustrates a fourth or final chronological time point.

As illustrated in FIG. 3A, the expanded sealing material 120 is in an expanded state. Upon heating, the expanded sealing material 120 begins to retract or return to a recovered state. As shown in FIG. 3B, the heat is initially applied to a top portion, and the sealing material in the top portion has transitioned to a recovered state 150. The sealing material in the middle portion has been indirectly heated and is beginning to transition. Accordingly, the middle portion can be said to be in a partially recovered state 140. The bottom portion has not been heated and remains in the expanded state 130.

As the heat is continually applied to the sealing material 120 and moved more directly to/over the middle portion, the middle portion continues to transition through the partially recovered state 140 of FIG. 3B to a recovered state 150 (shown in FIG. 3C). Also shown in FIG. 3C, the bottom portion has been indirectly or partially heated causing it to enter a partially recovered state 140. Additional heat is applied to the sealing material 120, particularly at or around the lower portion, causing it to complete its mechanical transition to a recovered state where the sealing material 120 of FIG. 3A has finally completed a transition to a seal 220 between the modular wall and the permanent structure, as shown in FIG. 3D.

It should be appreciated that FIGS. 3A-3D are exemplary in nature and are not intended to be construed as the only method of implementing systems, methods, and/or devices of the present disclosure. In some implementations, the sealing material undergoes a uniform transition between the expanded and recovered state across the entire surface thereof. For example, multiple heat sources can be used, or a uniform distribution of heat applied to the sealing material. Further, the directionality of shrinking shown in FIGS. 3A-3D can be reversed (e.g., from the bottom up), can progress from the inside out or from the peripheral edges in, or it can be performed in a zig-zag, circular, or other pattern.

In some implementations, portions of the sealing material are not fully transitioned between an expanded state to a recovered state. Portions of the sealing material can, for example, remain in a partially recovered state. Nonetheless, the sealing material may, in some implementations, form a sufficient seal to enable one or more of airtightness, water tightness, sound baffling, visual occlusion, and/or structural reinforcement.

Additionally, or alternatively, the sealing material can be transitioned from an expanded state to a recovered state in two directions. The sealing material 120 of FIGS. 3A-3D transitions along the transverse axis of the sealing material. In some implementations, the sealing material could additionally, or alternatively, transition along the longitudinal axis of the sealing material. This could be beneficial, for example, to seal gaps or spaces between the modular wall and adjacent permanent structures (e.g., the ceiling or floor). In some implementations, the sealing material includes different shrink ratios along the transverse and longitudinal axes such that it transitions from an expanded state to a recovered state differently along each axis.

Figure 4:
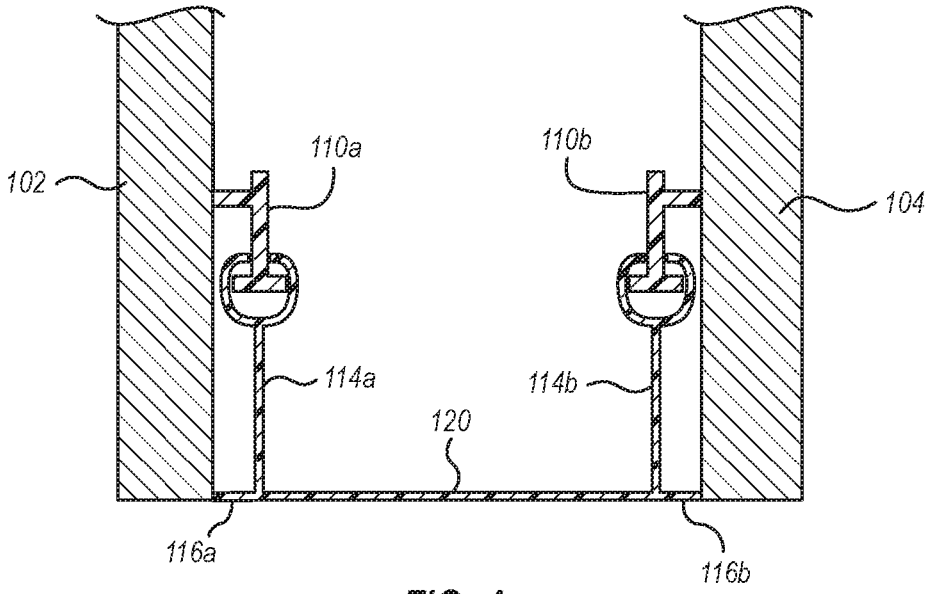
FIG. 4 illustrates a top plan view of a horizontal cross-section of a system for sealing a wall in accordance with one implementation of the present disclosure.

Referring now to FIG. 4, illustrated is a cross-sectional view of a sealing device associated with a modular wall 102 on a first side and a preexisting wall 104 on the opposing side. As illustrated, the sealing material 120 is in a recovered state, and the extension elements 116*a*, 116*b* thereof are in contact with the surfaces of the modular wall 102 and the preexisting wall 104. In some implementations, this creates a fluidtight and/or airtight seal or otherwise seals the space between the modular wall and the preexisting wall.

Figure 5:
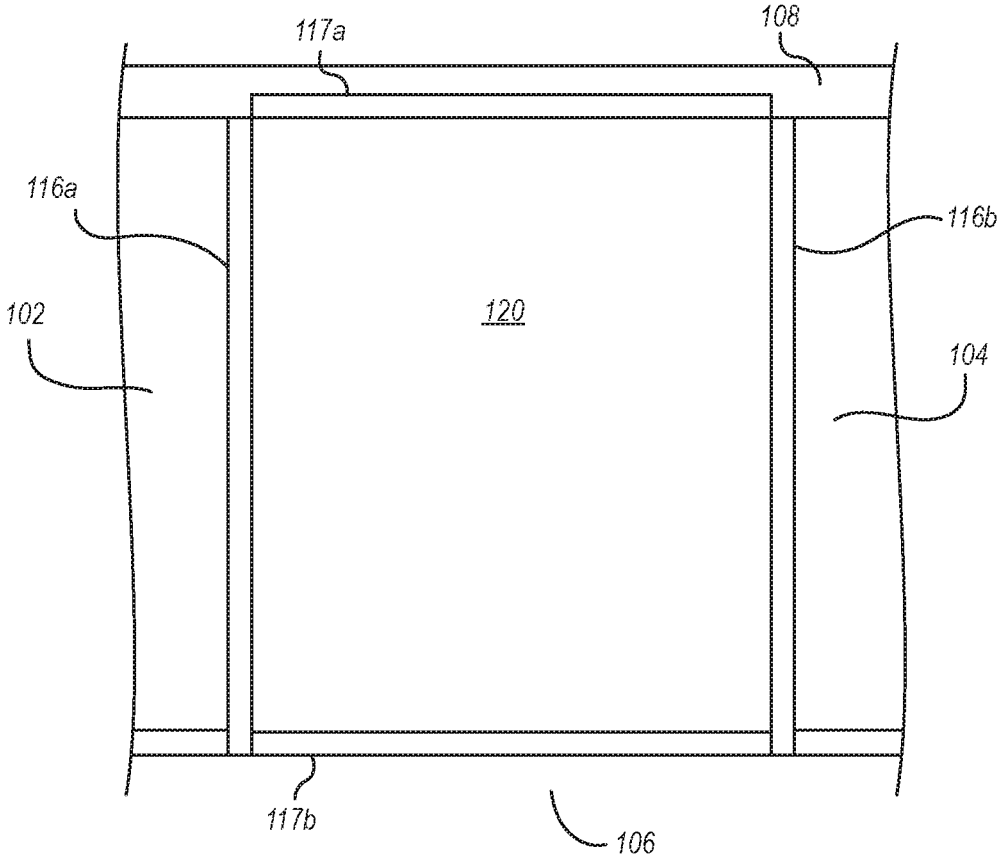
FIG. 5 illustrates a front view of a system for sealing a wall in accordance with one implementation of the present disclosure.

While FIG. 4 illustrates the sealing device as having extension elements 116*a*, 116*b* associated with terminal ends of the sealing material 120 that are oriented along the sealing material 120 in the same direction as the longitudinal axis thereof, it should be appreciated that the sealing device may additionally, or alternatively, include extension elements disposed on the top and/or bottom of the sealing material and which extend along the sealing material in the same direction as the transverse axis of the sealing material (as shown in FIG. 5). Accordingly, as the sealing material transitions to a recovered state, the extension elements can associate with other preexisting structures (e.g., upper/lower walls, floors, ceilings, etc.) and provide additional sealing surfaces to seal the space defined by the sealing material, the modular wall, and the associated permanent structure.

As shown in FIGS. 4 and 5, the extension elements 116*a*, 116*b*, 117*a*, 117*b* can extend a distance from the terminal ends of the sealing material such that the extension elements form a seal with the modular wall, permanent structure, or components thereof. Accordingly, in some embodiments, the extension elements extend a distance of ⅛ inch, ¼ inch, ⅜ inch, ½ inch, ⅝ inch, ¾ inch, ⅞ inch, 1 inch, 1.25 inches, 1.5 inches, 1.75 inches, 2 inches, or more away from the terminal end of the sealing material. The extension elements can be made of or include the same material as the sidewalls, attachment member, or sealing material and may be chosen based on the desired application. For example, the extension elements may be made of or include silicone or a silicone containing polymer. As an additional example, the extension elements may be made of or include polyolefin, polyurethane, neoprene, polyvinylchloride, or polypropylene as part of a heat shrink material or non-heat-shrink material. In some implementations, it may be beneficial to include extension elements that are made of or include non-heat-shrinking material such that a seal formed between the extension elements and the modular wall or permanent structure is not subject to materially change in response to applied heat.

In some implementations, the extension elements 116*a*, 116*b* can abut the permanent structure 104 or modular wall 102, as shown in FIG. 4, or the extension elements 116*a*, 116*b*, 117*a*, 117*b* can overlap the surface of the permanent structure 104, 106, 108, or modular wall 102, as shown in FIG. 5. In either configuration, the extension elements can be configured to form a seal therewith. In some implementations, it is advantageous to have the extension elements overlap the permanent structure or modular wall as it can accommodate greater variability in surface topology, degree of sealing material transitioning, or similar while still maintaining a seal.

In some implementations, the sealing material is translucent. In some implantations, the sealing material is opaque. In some implementations, the sealing material is visible. In some implementations, the sealing material is covered by a cladding. The cladding may be prepared and cut ahead of time or it can, in some implementations, be cut on site to fit over or otherwise obscure the sealing material from sight.

Implementations of the present disclosure can be beneficial in, for example, hospital settings, where airtight seals can prevent the transmission of disease. The seals may additionally provide a sound barrier that can act to increase the privacy of areas defined and/or partitioned by modular walls. Additionally, in some implementations, the seals can act to provide structural continuity between the modular wall and the permanent structure that may otherwise have been impractical given a misalignment of the modular wall and the permanent structure.

Unless defined otherwise, all technical and scientific terms used herein have the same meaning as commonly understood by one of ordinary skill in the art to which the present disclosure pertains.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," "involves," "contains," etc.), and similar terms as used herein, including within the claims, shall be inclusive and/or open-ended, shall have the same meaning as the word "comprising" and variants thereof (e.g., "comprise" and "comprises"), and do not exclude additional un-recited elements or method steps, illustratively.

It will be noted that, as used in this specification and the appended claims, the singular forms "a," "an" and "the" include plural referents unless the context clearly dictates otherwise. Thus, for example, reference to a singular referent (e.g., "widget") includes one, two, or more referents. Similarly, reference to a plurality of referents should be interpreted as comprising a single referent and/or a plurality of referents unless the content and/or context clearly dictate otherwise. For example, reference to referents in the plural form (e.g., "widgets") does not necessarily require a plurality of such referents. Instead, it will be appreciated that independent of the inferred number of referents, one or more referents are contemplated herein unless stated otherwise.

As used herein, directional terms, such as "top," "bottom," "left," "right," "up," "down," "upper," "lower," "proximal," "distal" and the like are used herein solely to indicate relative directions and are not otherwise intended to limit the scope of the disclosure and/or claimed invention.

To facilitate understanding, like reference numerals (i.e., like numbering of components and/or elements) have been used, where possible, to designate like elements common to the figures. Specifically, in the exemplary embodiments illustrated in the figures, like structures, or structures with like functions, will be provided with similar reference designations, where possible. Specific language will be used herein to describe the exemplary embodiments.

Nevertheless, it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential).

Any headings used herein are for organizational purposes only and are not meant to be used to limit the scope of the description or the claims.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated. Furthermore, binding, coupling, attaching, connecting, and/or joining can comprise mechanical and/or chemical association.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A wall-sealing system for sealing a space defined between a modular wall and a permanent structure, comprising:

a modular wall; and a sealing material configured to be associated with the permanent structure and the modular wall and spanning the space defined therebetween, the space including a gap between the permanent structure and the modular wall, wherein:

the sealing material is configured to transform from an expanded state to a recovered state in response to stimulus, wherein the stimulus comprises heat and the sealing material is configured to contract from the expanded state to the recovered state when the sealing material is heated at or above a transition temperature, and the sealing material is configured to form a seal around the space defined between the modular wall and the permanent structure when the sealing material is in the recovered state;

an extension element disposed at a first end of the sealing material, wherein the extension element extends a distance from the first end of the sealing material in a direction away from the space defined between the modular wall and the permanent structure;

a first attachment member associated with a first end of the sealing material, the first attachment member configured to attach the sealing material to the modular wall; and a second attachment member associated with a second end of the sealing material, the second attachment member configured to attach to the permanent structure.

2. The wall-sealing system of claim 1, wherein the sealing material is selected from one or more of: polyolefin, polyurethane, neoprene, polyvinylchloride, or polypropylene.

3. The wall-sealing system of claim 2, wherein the transition temperature comprises about 75° C. to 150° C.

4. The wall-sealing system of claim 2, wherein the transition temperature comprises about 100° C.

5. The wall-sealing system of claim 2, wherein the transition temperature comprises about 125° C.

6. The wall-sealing system of claim 2, wherein the transition temperature comprises about 150° C.

7. The wall-sealing system of claim 1, wherein the sealing material comprises a translucent or opaque material.

8. The wall-sealing system of claim 1, wherein the permanent structure comprises one or more of a preexisting wall, a floor, or a ceiling.

9. The wall-sealing system of claim 1, wherein the seal is airtight.

10. The wall-sealing system of claim 1, further comprising:

a bracket configured to be associated with the permanent structure;

wherein the sealing material is configured to associate with the permanent structure via interaction between the first attachment member and the bracket.

11. The wall-sealing system of claim 10, wherein the sealing material associates with the modular wall via interaction between the second attachment member and a frame of the modular wall or a modular wall bracket associated therewith.

12. A wall-sealing device for sealing a space defined between a modular wall and a permanent structure, comprising:

a sealing material configured to contract from an expanded state to a recovered state in response to a stimulus, thereby sealing the space defined between the modular wall and the permanent structure, the space including a gap between the permanent structure and the modular wall, wherein the stimulus comprises heat and the sealing material contracts from the expanded state to the recovered state when the sealing material is heated at or above a transition temperature;

an extension element disposed at a first end of the sealing material, wherein the extension element extends a distance from the first end of the sealing material in a direction away from the space defined between the modular wall and the permanent structure;

a first attachment member associated with the first end of the sealing material, the first attachment member configured to attach the sealing material to the modular wall; and a second attachment member associated with a second end of the sealing material, the second attachment member configured to attach to the permanent structure.

13. The wall-sealing device of claim 12, wherein one or more of the first attachment member, the second attachment member, or the extension element comprises a different material than the sealing material.

14. The wall-sealing device of claim 12, wherein the sealing material comprises a heat shrink material selected from one or more of: polyolefin, polyurethane, neoprene, polyvinylchloride, or polypropylene.

15. The wall-sealing device of claim 12, further comprising:

a first sidewall coupled to the first attachment member at a first end thereof and to the first end of the sealing material at a second, opposite end thereof; and a second sidewall coupled to the second attachment member at a first end thereof and to the second end of the sealing material at a second, opposite end thereof.

16. A wall-sealing method for sealing a space between a permanent structure and a modular wall, comprising:

coupling an extension element to a first end of a sealing material of a sealing device;

coupling a first attachment member of the sealing device to the modular wall;

coupling a second attachment member of the sealing device to the permanent structure such that the sealing material of the sealing device spans the space defined between the modular wall and the permanent structure, the space including a gap between the permanent structure and the modular wall; and applying a stimulus to the sealing material to cause the sealing material to transition from an expanded state to a recovered state, thereby sealing the space defined between the modular wall and the permanent structure, wherein the stimulus comprises heat, wherein the sealing material is configured to contract from the expanded state to the recovered state in response to the sealing material being heated at or above a transition temperature.

17. The wall-sealing method of claim 16, wherein applying heat to the sealing material comprises heating the sealing material to a transition temperature between about 75° C. 150° C. or higher.

* * * * *